US007695031B2

(12) United States Patent
Jackson, Jr. et al.

(10) Patent No.: US 7,695,031 B2
(45) Date of Patent: Apr. 13, 2010

(54) SLAM LATCH WITH POP-UP KNOB

(75) Inventors: Joseph W. Jackson, Jr., Wilmington, DE (US); Claes Gunnar Wilhelm Magnusson, Weybridge (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/577,693

(22) PCT Filed: Oct. 22, 2005

(86) PCT No.: PCT/US2005/037775

§ 371 (c)(1),
(2), (4) Date: Apr. 20, 2007

(87) PCT Pub. No.: WO2006/047229

PCT Pub. Date: May 4, 2006

(65) Prior Publication Data

US 2007/0216169 A1 Sep. 20, 2007

Related U.S. Application Data

(60) Provisional application No. 60/621,458, filed on Oct. 23, 2004.

(51) Int. Cl.
*E05C 1/12* (2006.01)
*E05B 27/00* (2006.01)

(52) U.S. Cl. ..... 292/169; 292/65; 292/170; 292/DIG. 37; 70/134; 70/208; 70/360; 70/DIG. 20

(58) Field of Classification Search ..... 292/169, 292/170, DIG. 4, DIG. 37, 65; 70/134, 208, 70/360, 361, DIG. 20
See application file for complete search history.

(56) References Cited

U.S. PATENT DOCUMENTS

| | | | |
|---|---|---|---|
| 147,817 | A | 2/1874 | Bryant |
| 248,883 | A | 11/1881 | Ralston |
| 312,769 | A | 2/1885 | Scott |
| 432,389 | A | 7/1890 | Everhart |
| 433,309 | A | 7/1890 | Shaaber |
| 1,900,725 | A | 3/1933 | Moffett |
| 2,233,278 | A | 2/1941 | Aldeen |
| 2,696,399 | A | 12/1954 | Jacobi |
| 2,726,887 | A | 12/1955 | Pierotti |
| 2,905,147 | A | 9/1959 | Johmann |
| 3,287,944 | A | 11/1966 | Crumb |
| 3,288,115 | A | 11/1966 | Hechtle |
| 3,315,395 | A | 4/1967 | Kirklen |

(Continued)

*Primary Examiner*—Carlos Lugo
(74) *Attorney, Agent, or Firm*—Paul & Paul

(57) ABSTRACT

A latch has a pop-up knob that provides a handle for pulling on a door when the knob is extended. The door can be closed with the knob either up or down. With the knob up, the latch pawl can be disengaged from a keeper attached to the door frame by pulling the door open. With the knob down, the latch pawl remains in an extended position behind the keeper and the door cannot be pulled open. The knob can be selectively retained in the down position, and placing the knob in the down position results in the rotational movement of the latch pawl being blocked.

18 Claims, 17 Drawing Sheets

U.S. PATENT DOCUMENTS

| | | | | |
|---|---|---|---|---|
| 3,318,289 | A | | 5/1967 | Marynissen |
| 3,137,276 | A | | 6/1967 | Weisser |
| 3,456,557 | A | | 7/1969 | Hautau |
| 3,700,184 | A | | 10/1972 | Francis |
| 3,819,282 | A | | 6/1974 | Schultz |
| 3,862,773 | A | | 1/1975 | Bisbing |
| 3,919,866 | A | * | 11/1975 | Lipschutz ..... 70/81 |
| 4,153,274 | A | | 5/1979 | Rogers, Jr. et al. |
| 4,249,761 | A | * | 2/1981 | Nishimura ..... 292/251.5 |
| 4,486,007 | A | | 12/1984 | Kuhlman |
| 4,732,347 | A | | 3/1988 | Stamboulian et al. |
| 4,856,726 | A | | 8/1989 | Kang |
| 4,978,152 | A | | 12/1990 | Bisbing |
| 5,055,643 | A | | 10/1991 | Pardini et al. |
| 5,235,832 | A | | 8/1993 | Lux et al. |
| D344,930 | S | | 3/1994 | Schaeffer |
| 5,384,442 | A | | 1/1995 | Danner |
| 5,479,800 | A | | 1/1996 | Myers |
| 5,722,275 | A | | 3/1998 | Price et al. |
| D410,190 | S | | 5/1999 | Freck |
| 6,059,326 | A | | 5/2000 | Tramontina |
| 6,113,160 | A | | 9/2000 | Johansson et al. |
| D435,427 | S | | 12/2000 | Sokurenko |
| D437,835 | S | | 2/2001 | Decosse |
| 6,460,902 | B1 | | 10/2002 | Kyle |
| 6,463,774 | B2 | | 10/2002 | Sokurenko |
| 6,501,037 | B2 | | 12/2002 | Gressier et al. |
| 6,575,503 | B1 | | 6/2003 | Johansson et al. |
| 6,651,467 | B1 | | 11/2003 | Weinerman et al. |
| 6,757,503 | B2 | | 6/2004 | Kamimura |
| 6,782,725 | B2 | | 8/2004 | Linares |
| 7,152,892 | B2 | * | 12/2006 | Rechberg ..... 292/304 |
| D537,317 | S | | 2/2007 | Jackson, Jr. |
| D546,661 | S | | 7/2007 | Jackson, Jr. |
| 2001/0027667 | A1 | | 10/2001 | Pinkow et al. |
| 2003/0193199 | A1 | | 10/2003 | Talukdar et al. |

* cited by examiner

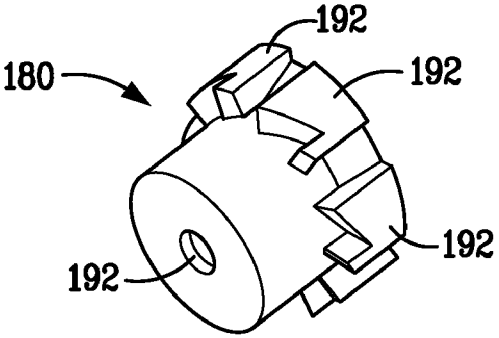
FIG. 33
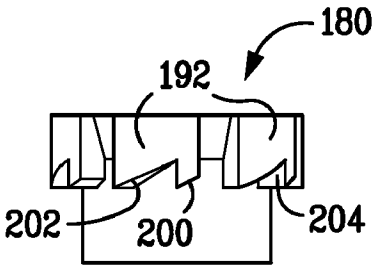
FIG. 34
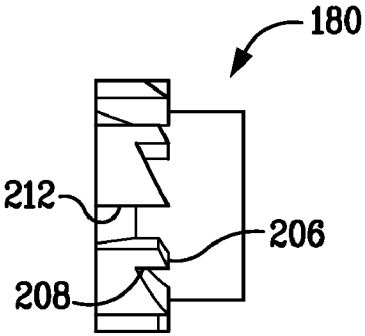
FIG. 35
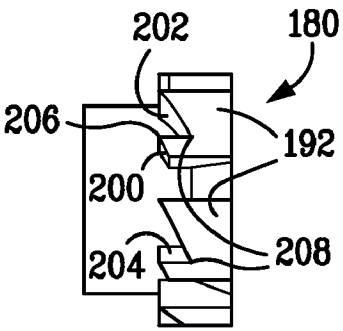
FIG. 36
FIG. 37
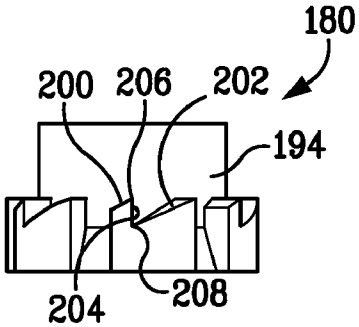
FIG. 38
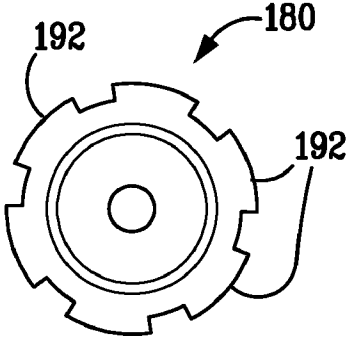
FIG. 39

SLAM LATCH WITH POP-UP KNOB

BACKGROUND OF THE INVENTION

1. Field of Invention

The present invention relates to the field of latch assemblies.

2. Brief Description of the Related Art

Latch assemblies are relied on in many applications for securing items, such as panels, doors, and doorframes together. Various latches for panel closures have been employed where one of the panels such as a swinging door or the like is to be fastened or secured to a stationary panel, doorframe, or compartment. Although many latch assemblies are known in the prior art, none are seen to teach or suggest the unique features of the present invention or to achieve the advantages of the present invention.

SUMMARY OF THE INVENTION

The present invention is directed to a latch having a pop-up knob. When the knob is extended it provides a handle for pulling on a door. The door can be closed with the knob either up or down. With the knob up, the latch pawl can be disengaged from a keeper attached to the doorframe by pulling the door open. With the knob down, the latch pawl remains in an extended position behind the keeper and the door cannot be pulled open. The latch further includes means for selectively retaining the knob in the retracted or down position, and means to block the rotational movement of the latch pawl when the knob is in the down position.

BRIEF DESCRIPTION OF THE DRAWINGS

FIGS. 33-39 are views of the ratchet of the latch according to the present invention.

DETAILED DESCRIPTION OF THE INVENTION

Figure 1:
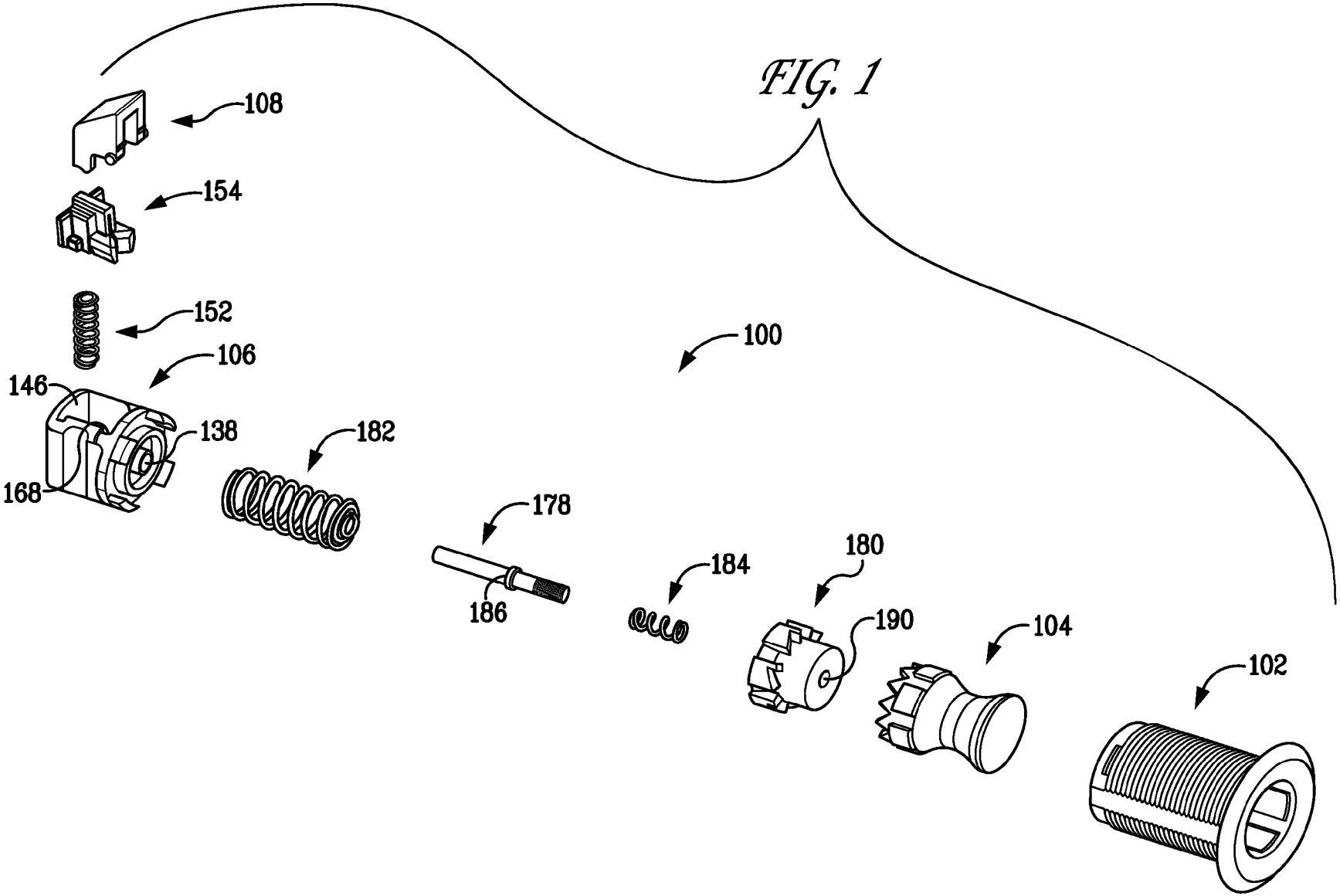
FIG. 1 is an exploded view of the latch according to the present invention.
Figure 4:
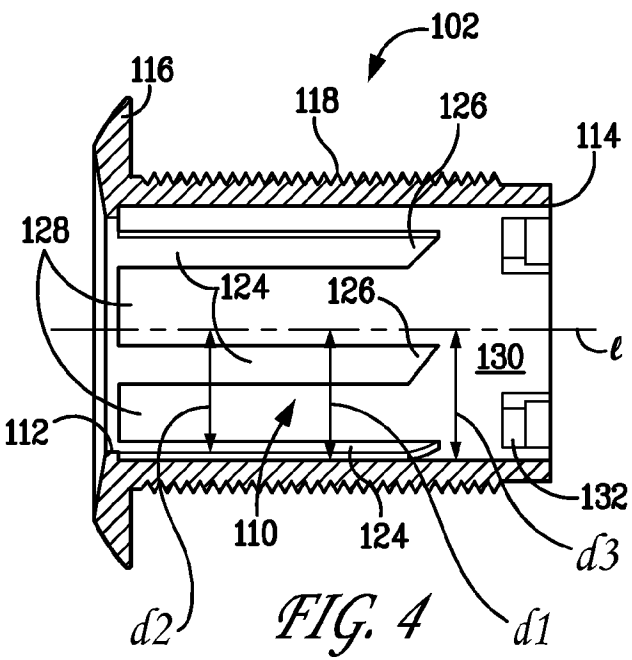
FIGS. 2-4 are views of the upper housing of the latch according to the present invention.
Figure 3:
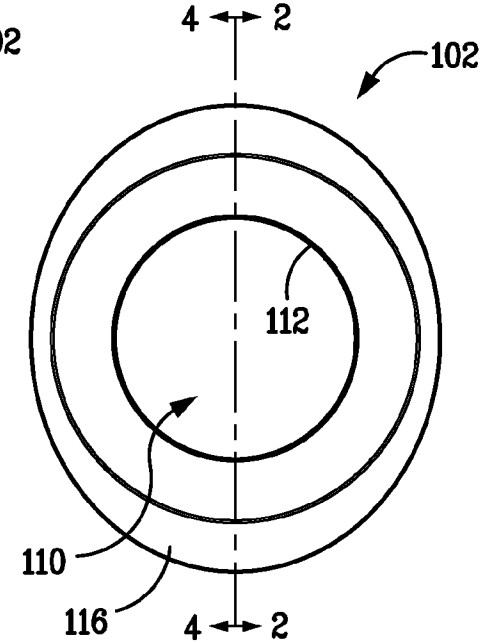
Figure 2:
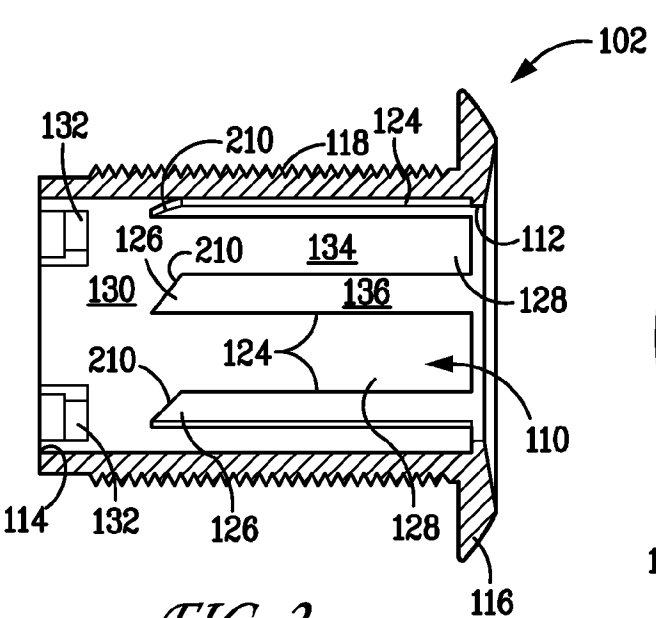
Figure 7:
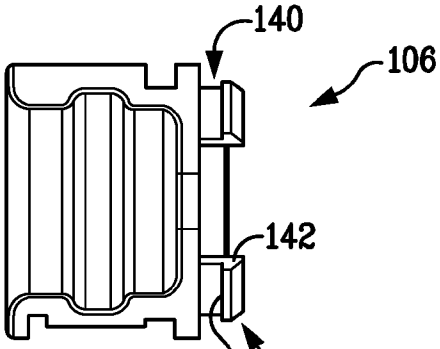
FIGS. 5-11 are views of the lower housing of the latch according to the present invention.
Figure 6:
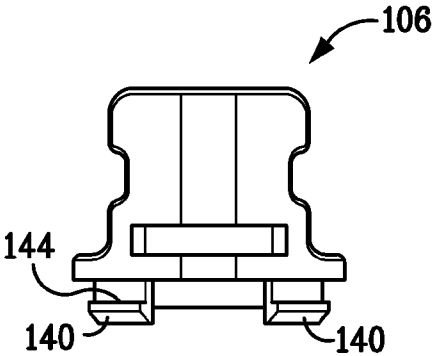
Figure 5:
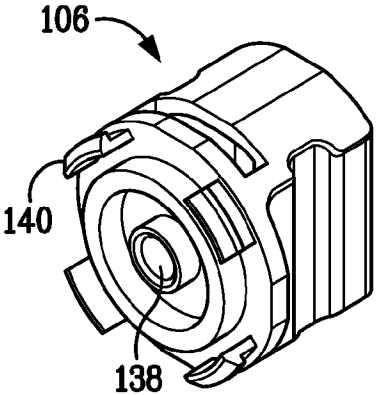
Figure 11:
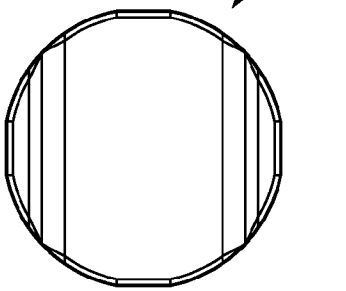
Figure 10:
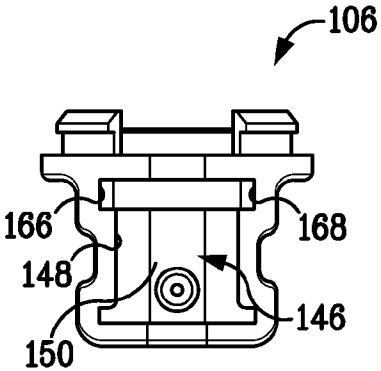
Figure 9:
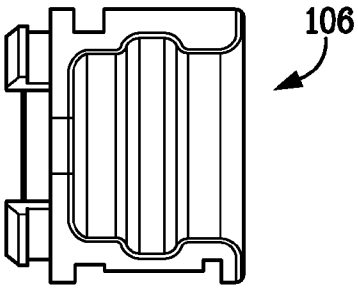
Figure 8:
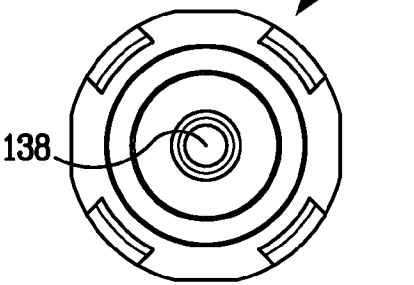
Figure 14:
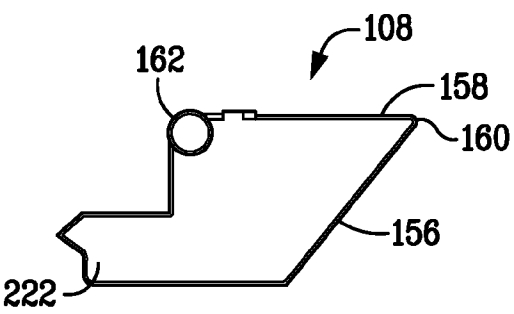
FIGS. 12-18 are views of the pawl of the latch according to the present invention.
Figure 13:
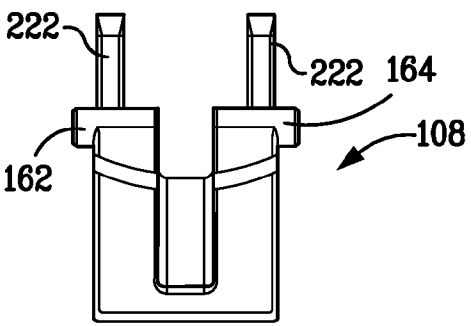
Figure 12:
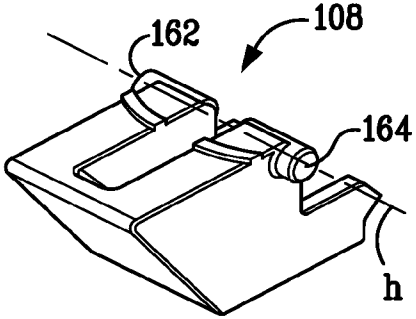
Figure 18:
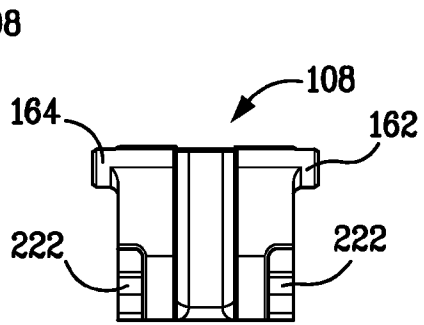
Figure 17:
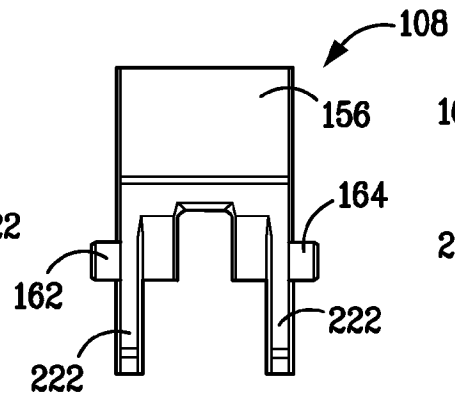
Figure 16:
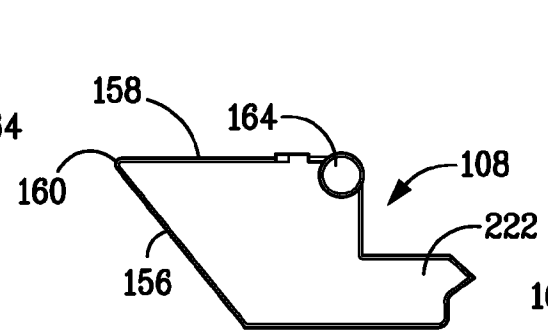
Figure 15:
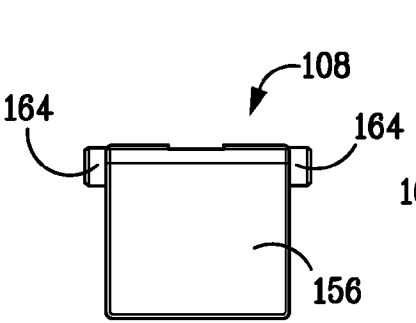
Figure 19:
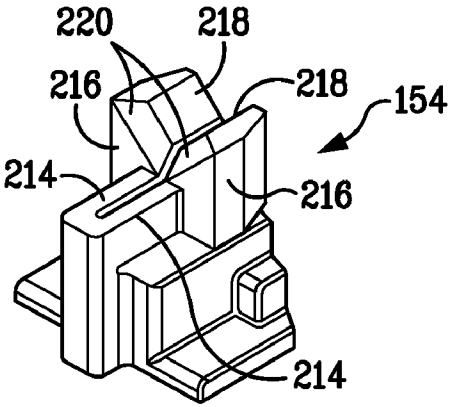
FIGS. 19-25 are views of the rectilinearly moving guide of the latch according to the present invention.
Figure 20:
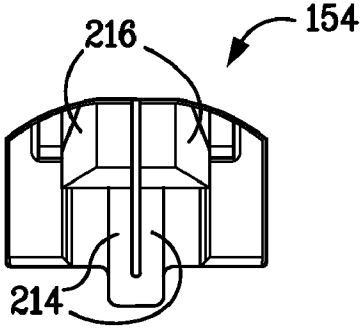
Figure 21:
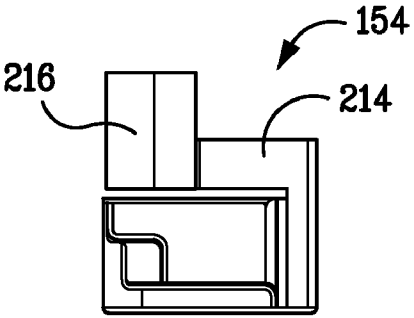
Figure 22:
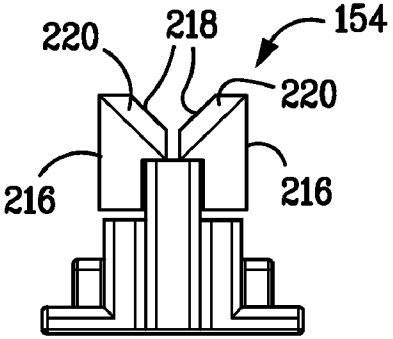
Figure 23:
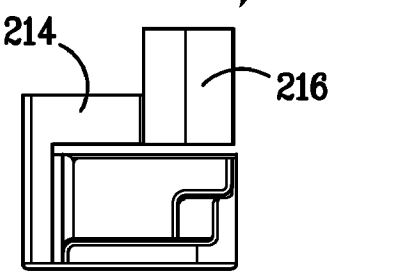
Figure 24:
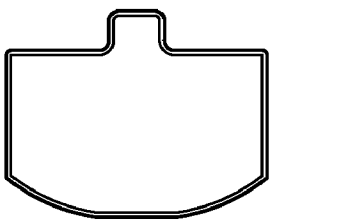
Figure 25:
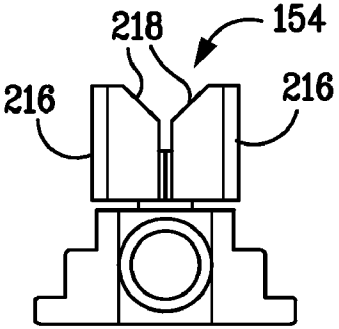
Figure 28:
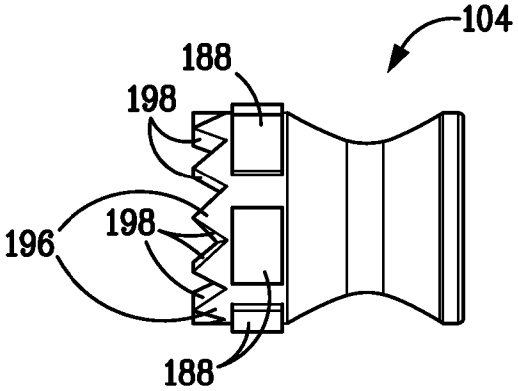
FIGS. 26-32 are views of the knob of the latch according to the present invention.
Figure 27:
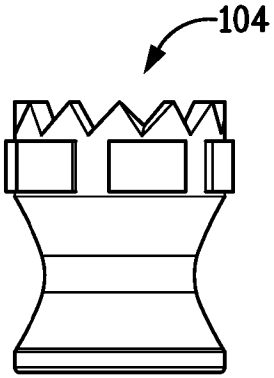
Figure 26:
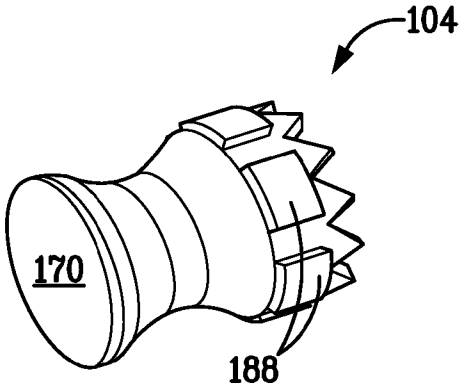
Figure 32:
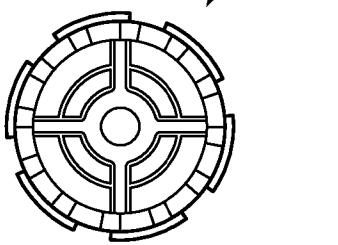
Figure 31:
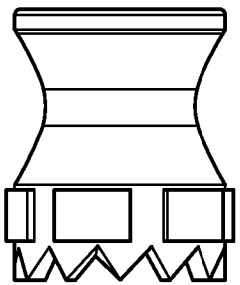
Figure 30:
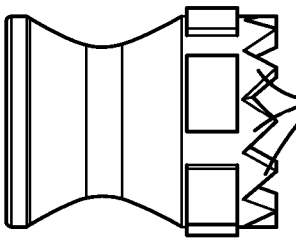
Figure 29:
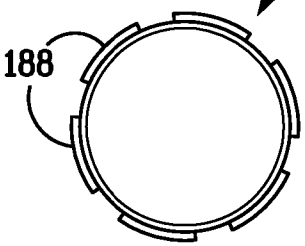
Figure 40:
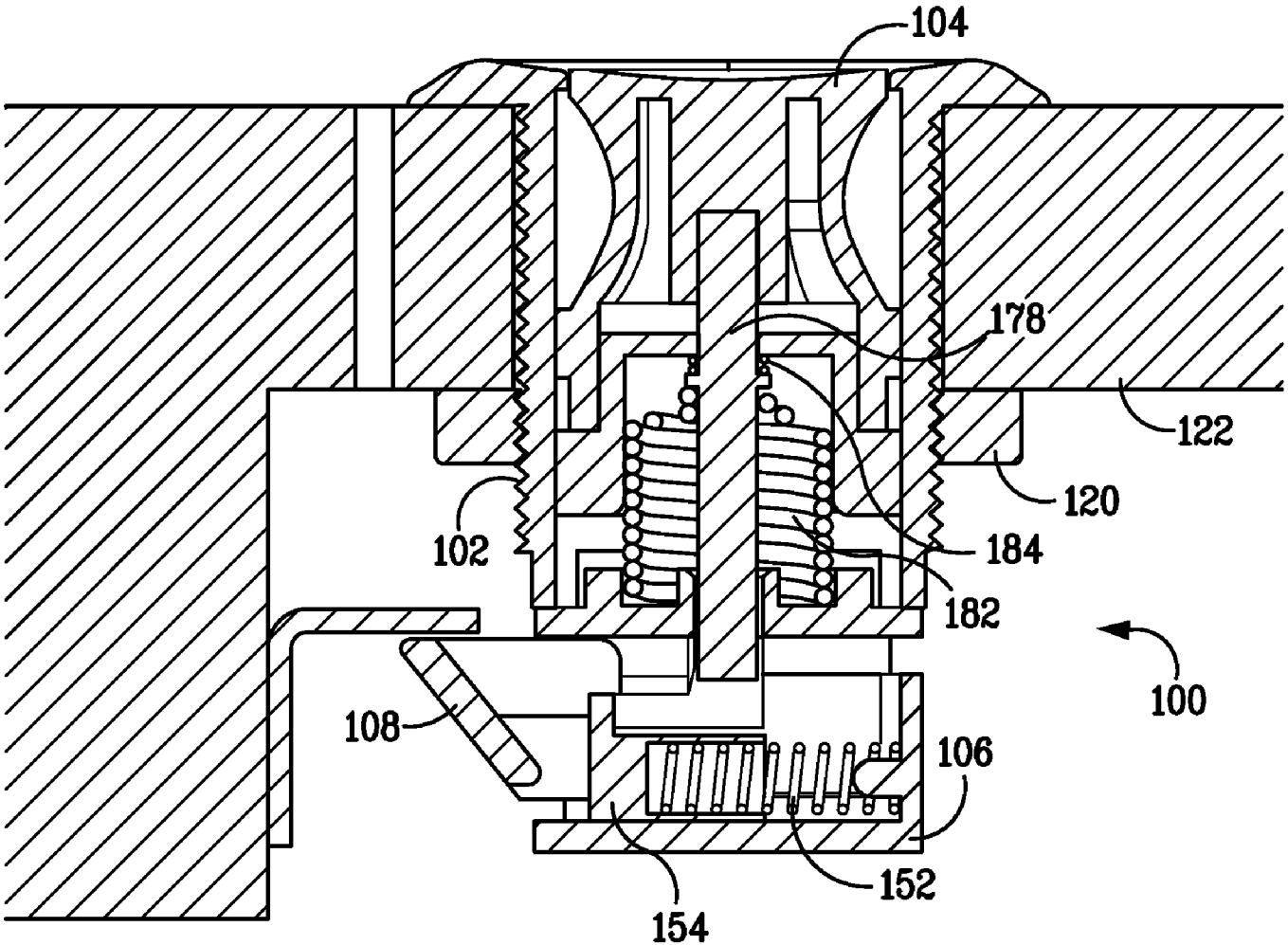
FIG. 40 is an environmental view of the latch according to the present invention shown securing a door with the latch knob in the retracted position.
Figure 41:
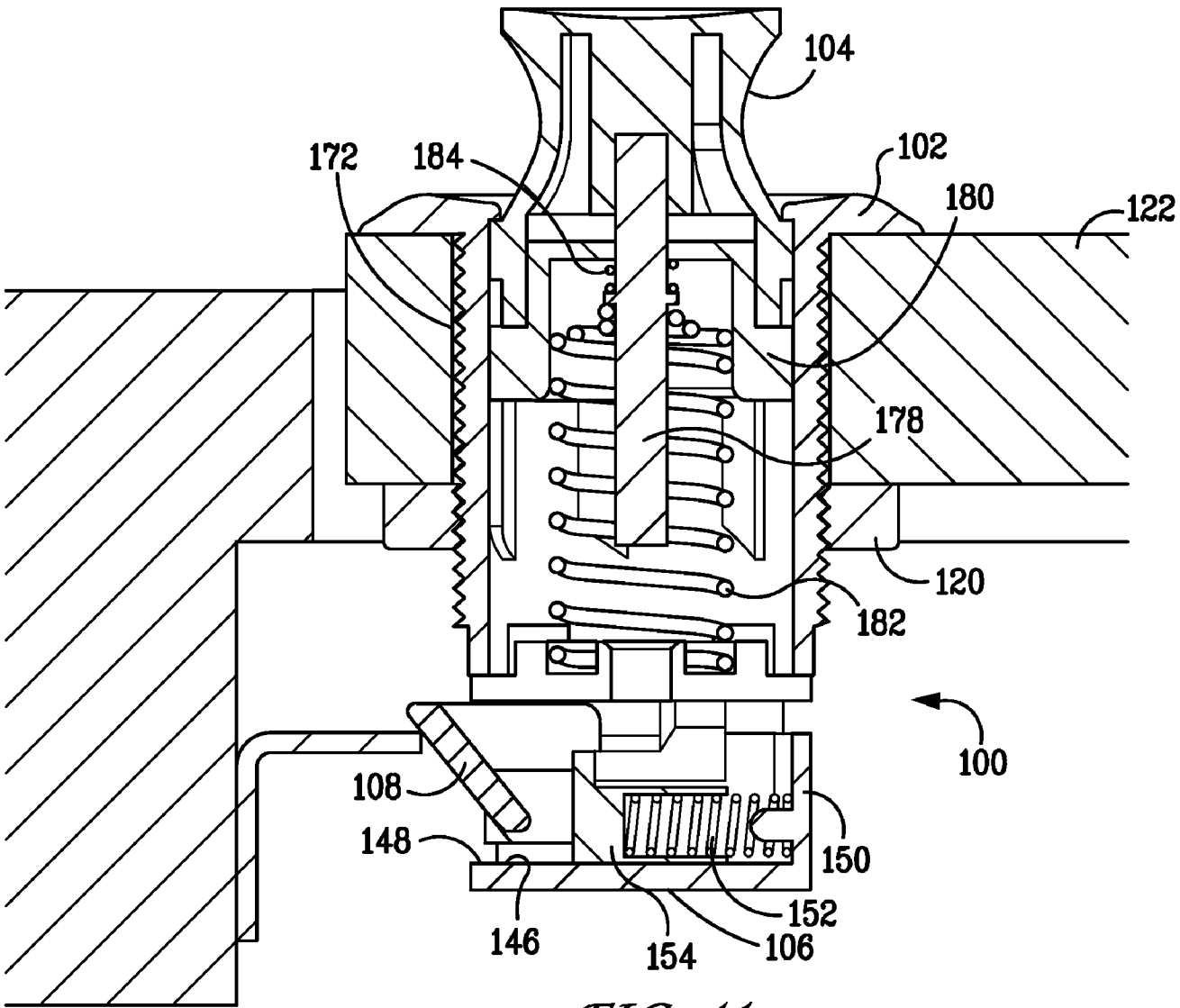
FIG. 41 is an environmental view of the latch according to the present invention shown during closing of the door with the knob extended.
Figure 42:
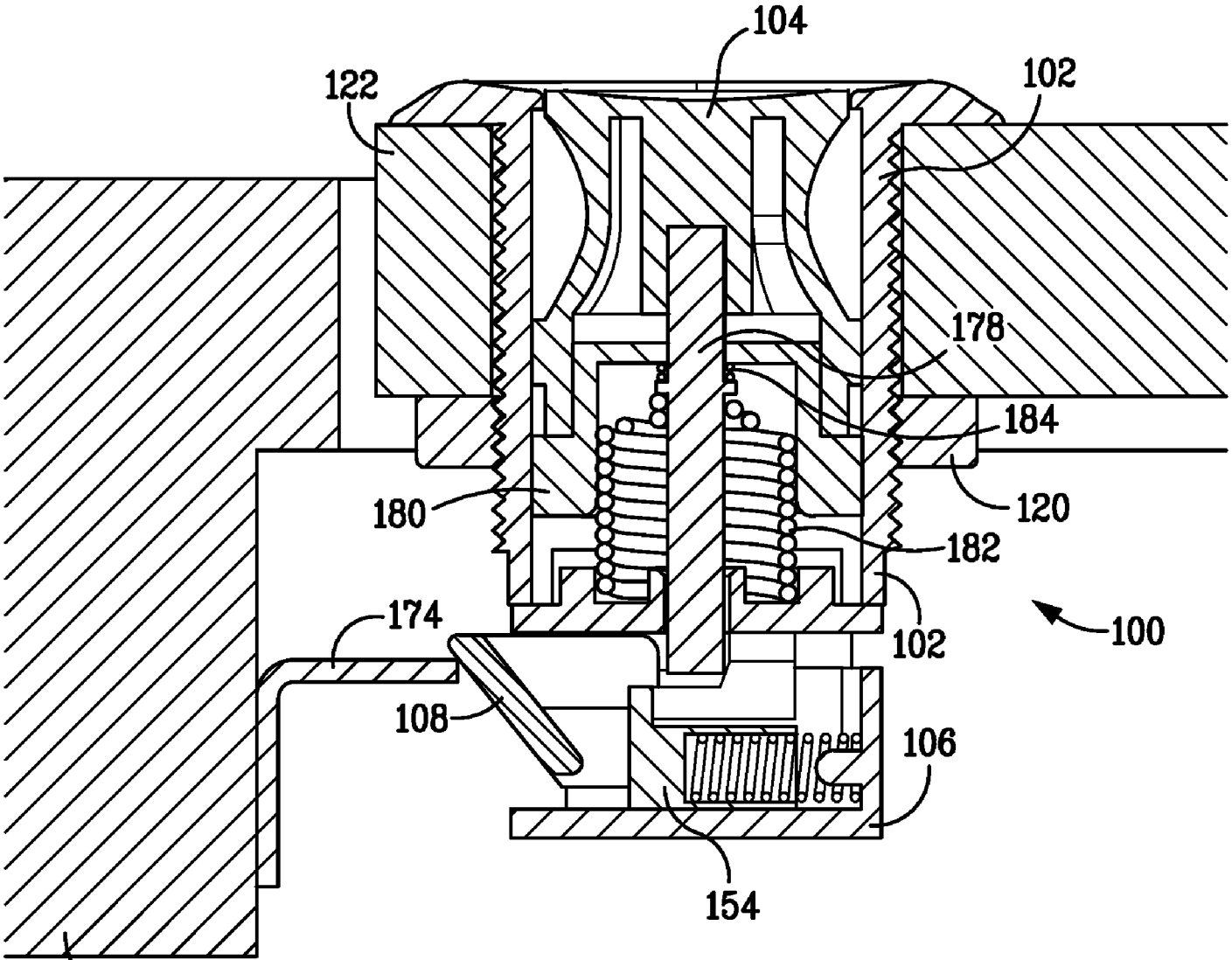
FIG. 42 is an environmental view of the latch according to the present invention shown during closing of the door with the knob retracted.
Figure 43:
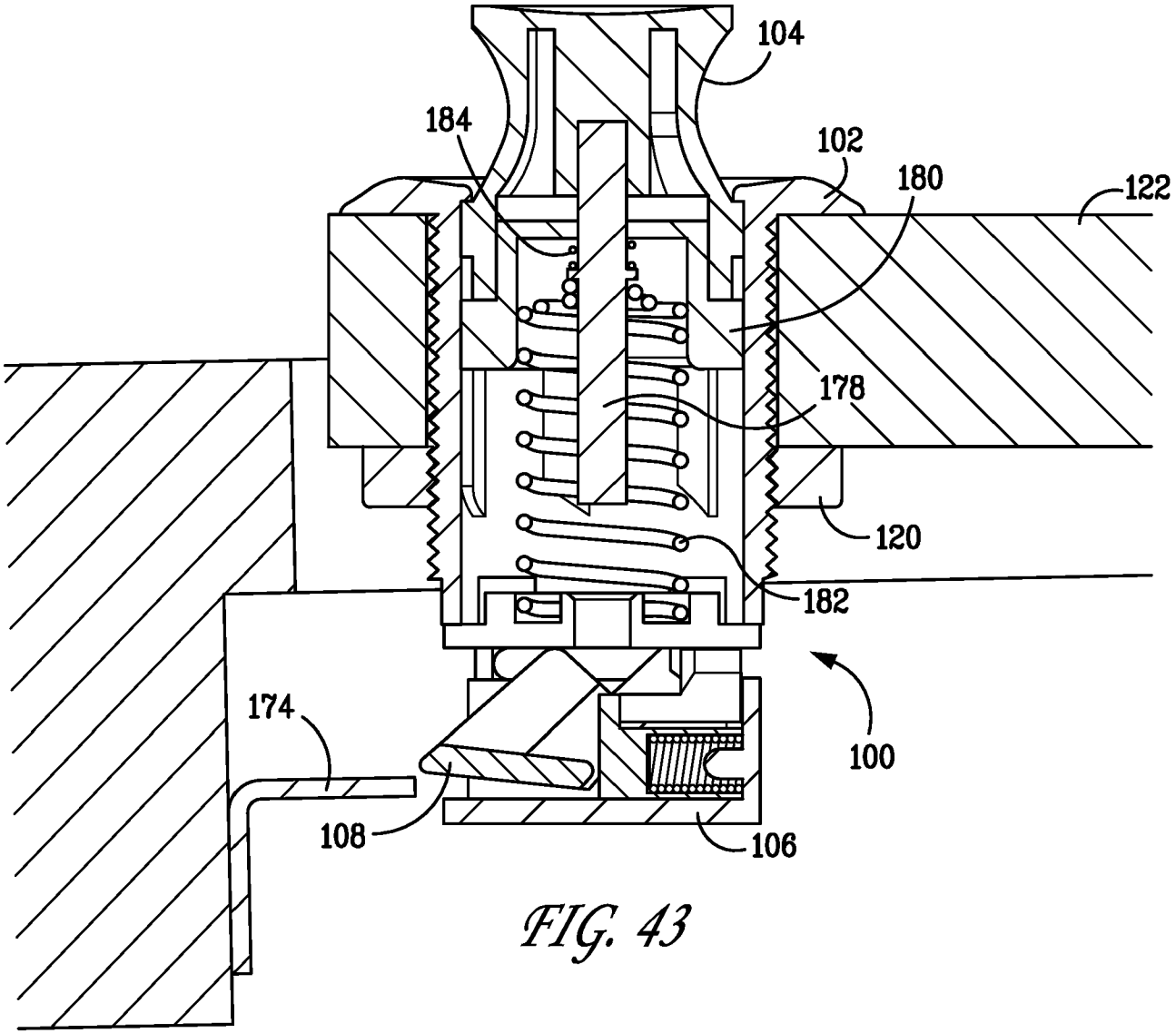
FIG. 43 is an environmental view of the latch according to the present invention shown during opening of the door with the knob extended.
Figure 44:
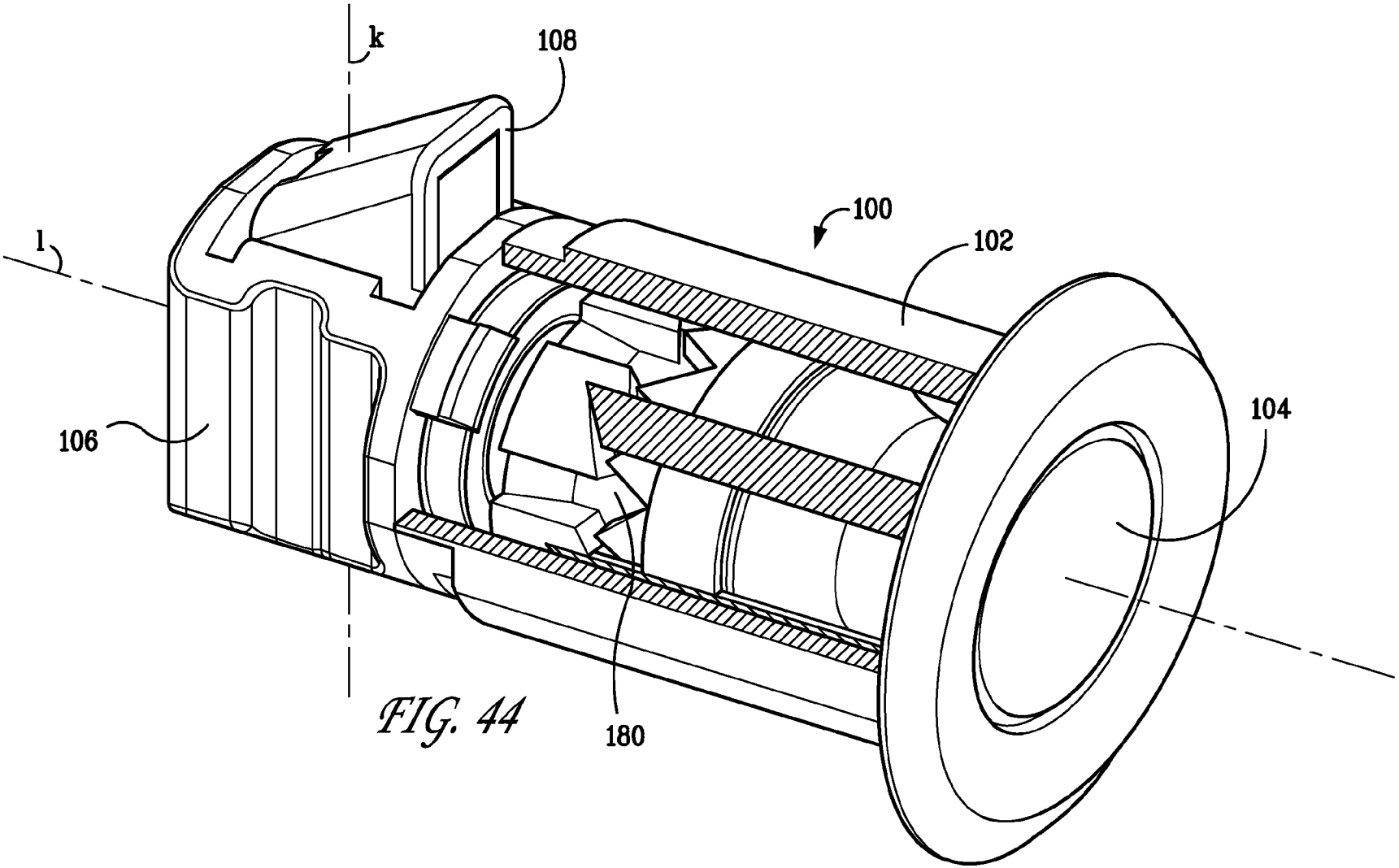
FIGS. 44-48 illustrate the operation of the means for selectively retaining the knob in the retracted position.
Figure 45:
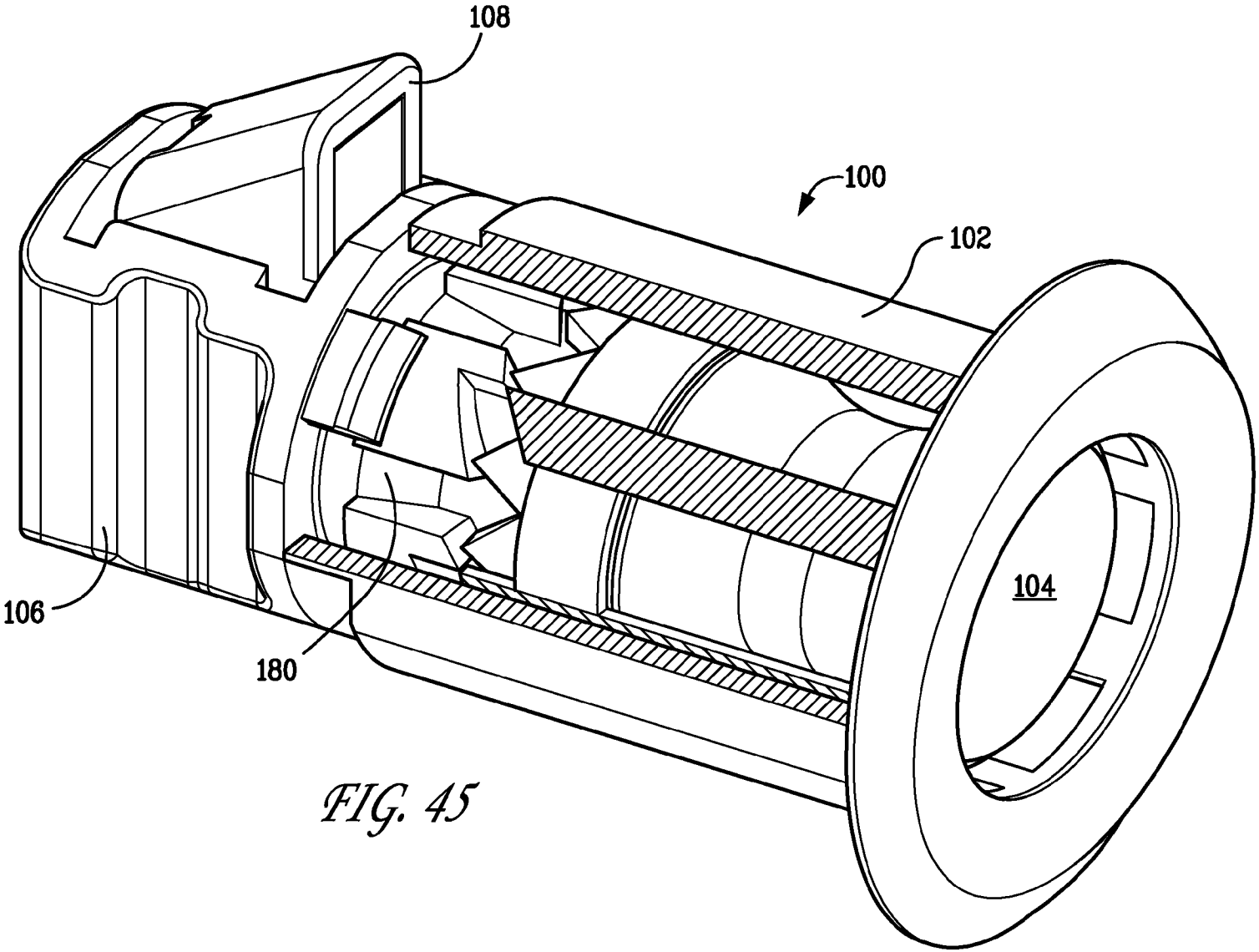
Figure 46:
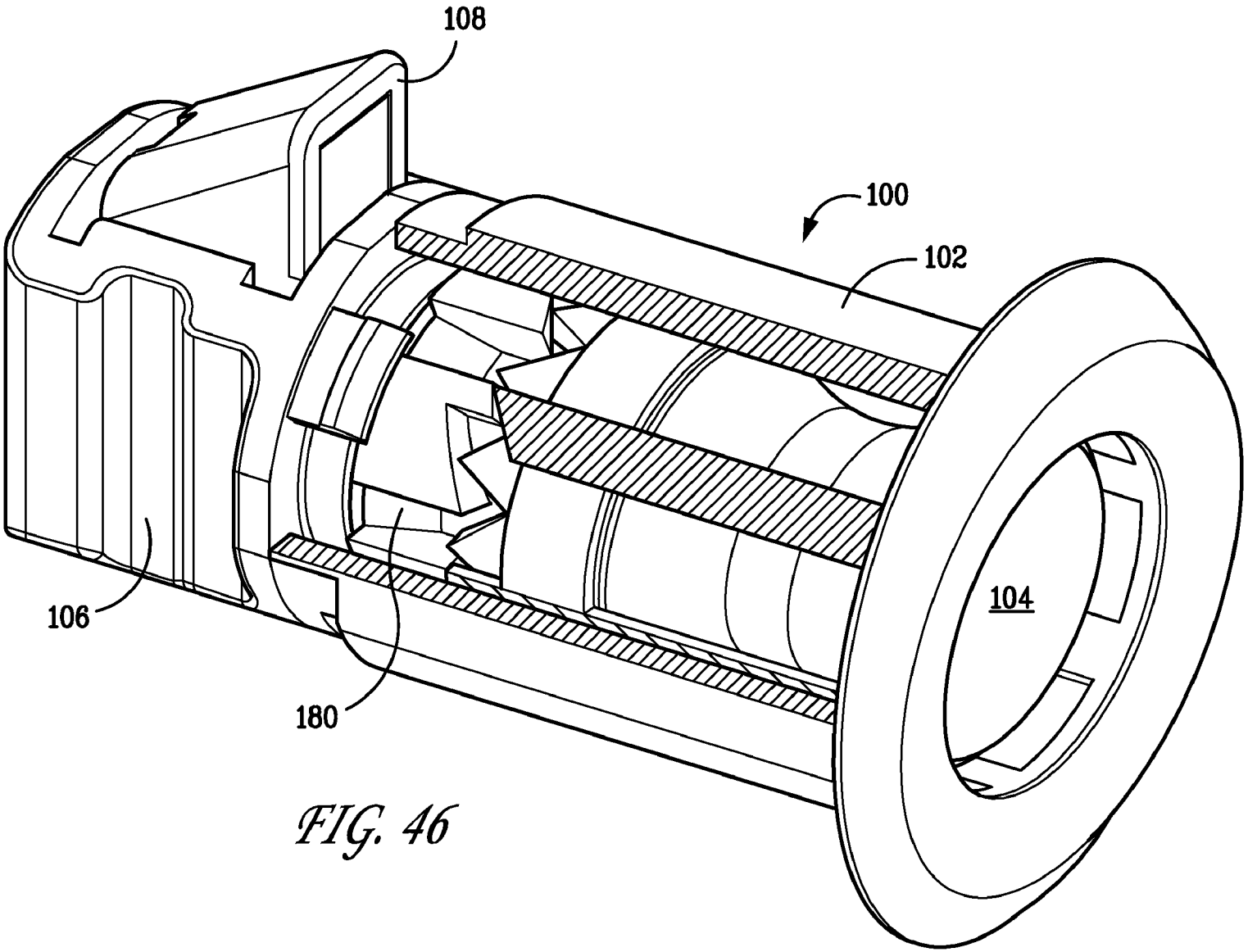
Figure 47:
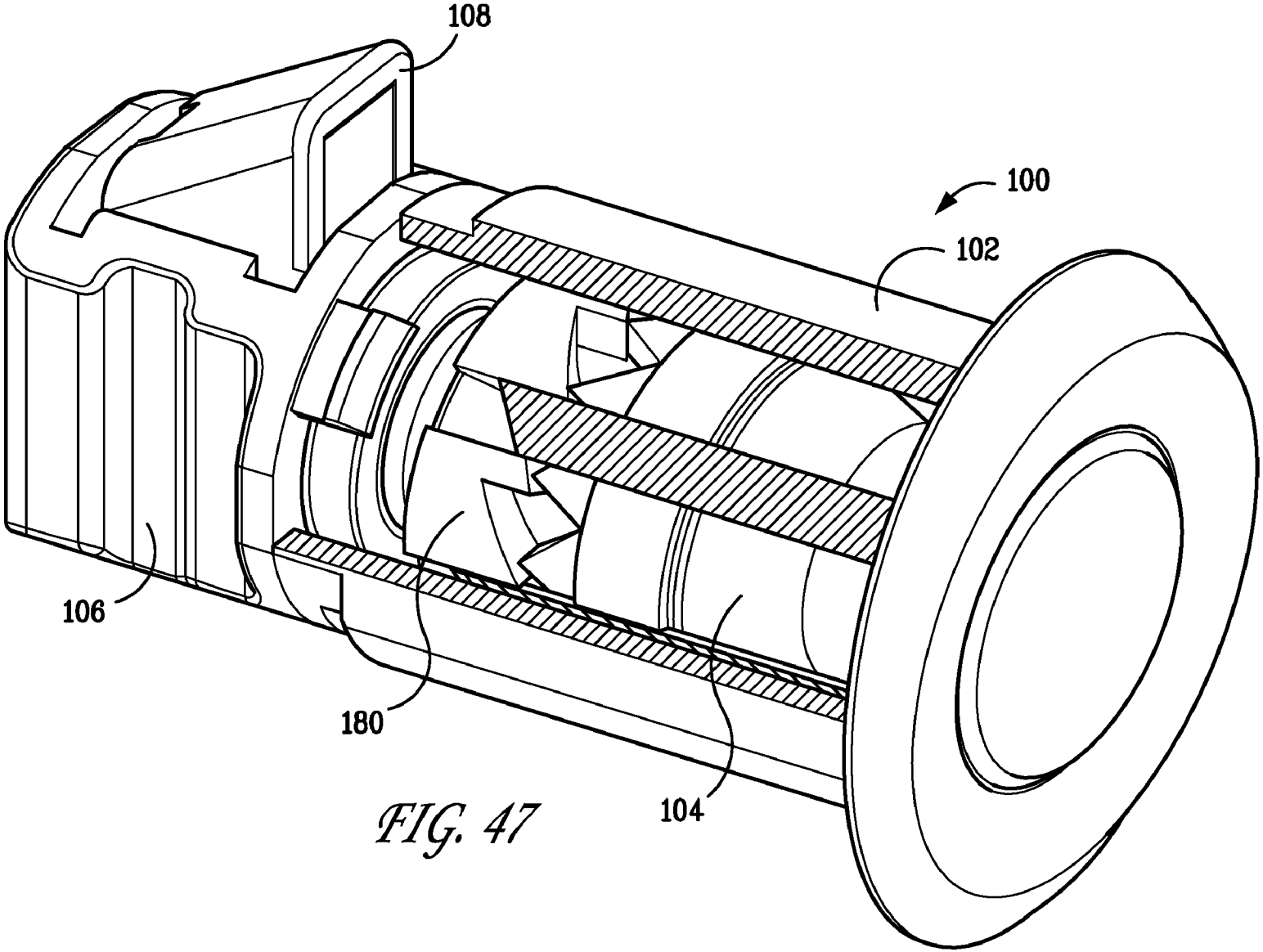
Figure 48:
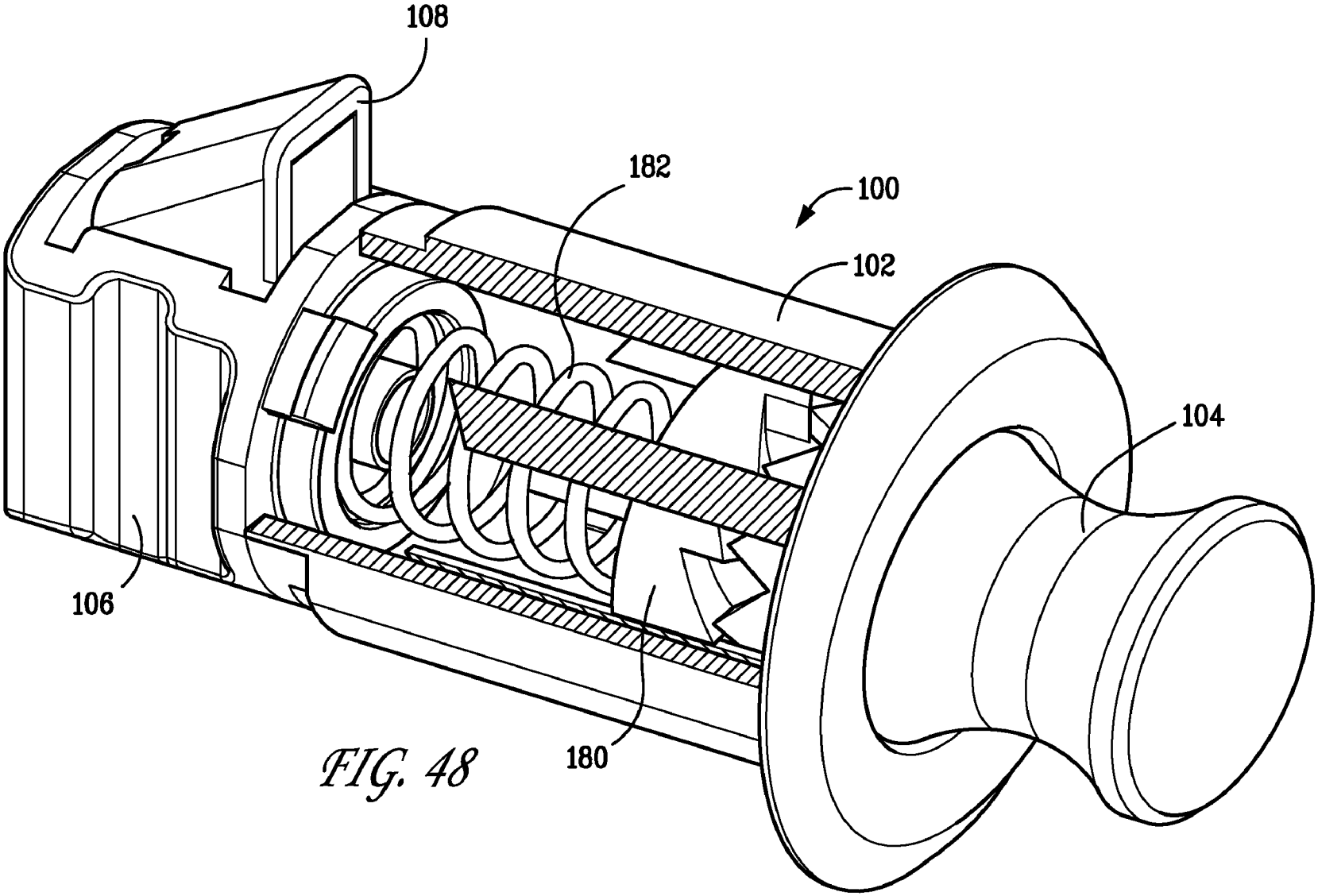
Figure 49:
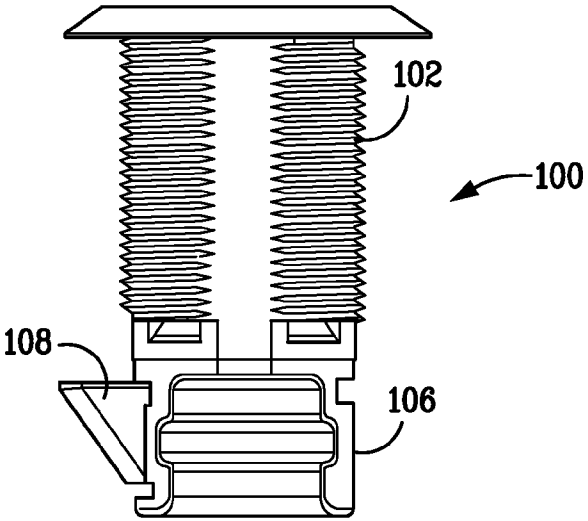
FIGS. 49-52 illustrate the different orientations in which the lower housing can be attached to the upper housing.
Figure 50:
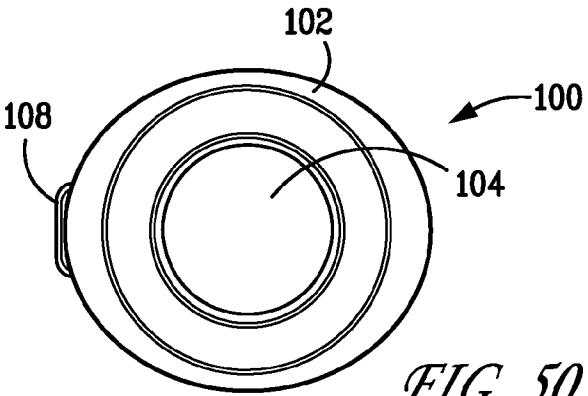
Figure 51:
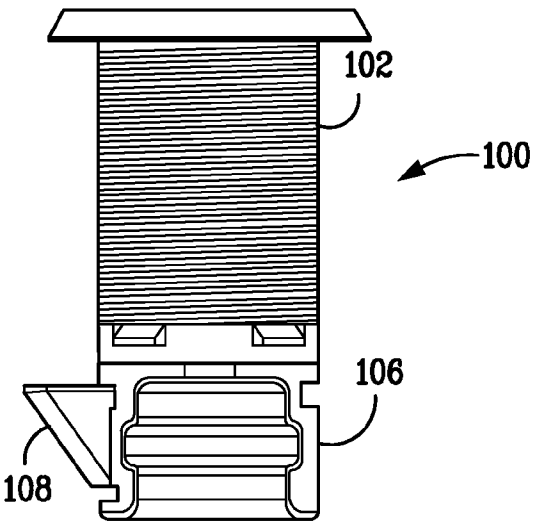
Figure 52:
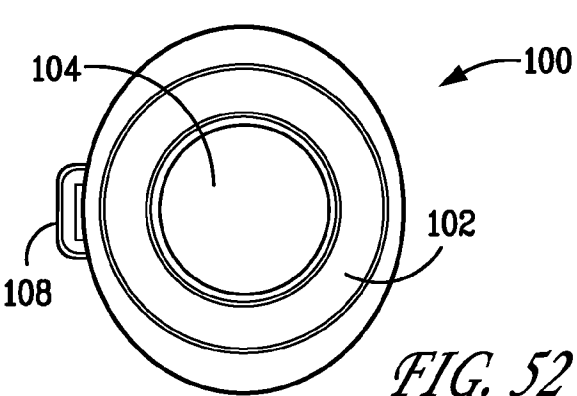
Figure 53:
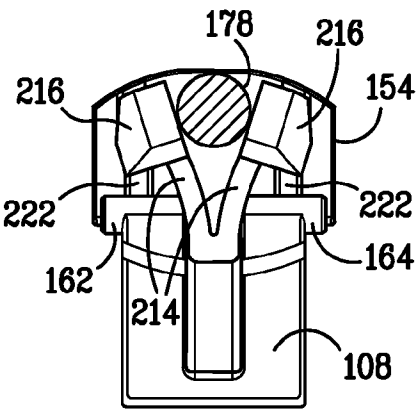
FIG. 53 is a fragmentary view showing the blocks of the pawl spread apart by the internal shaft of the latch according to the present invention.

The latch 100 includes an upper housing 102 supporting a pop-up knob 104 and a lower housing 106 supporting a pawl 108. The upper housing 102 is cylindrical in form and has a central bore 110 extending through its entire length. Accordingly, the upper housing 102 can be thought of as being tubular. The bore 110 of the upper housing forms a top opening 112 in the top end of the upper housing. Furthermore, the bore 110 of the upper housing 102 forms a bottom opening 114 in the bottom end of the upper housing. The upper housing 102 has a flange 116 surrounding its top end and in particular surrounding the top opening 112 of the upper housing. The exterior of the upper housing 102 is provided with interrupted screw threads 118 to allow for the use of a mounting nut 120 in securing the upper housing, and consequently the latch, to a closure member such as the door 122. The upper housing 102 is provided with a plurality of raised ribs 124 terminating in a chisel-shaped lower end 126. The raised ribs 124 are distributed evenly about the circumference of the cylindrical inner surface, i.e. the surface of the bore 110, of the upper housing 102. The raised ribs define a plurality grooves 128 such that each groove 128 is formed between each raised rib 124 and its nearest neighboring raised rib. The plurality of raised ribs 124 extend from near the top opening 112 in the top end of the upper housing 102 to a predetermined distance away from the bottom opening 114 in the bottom end of the upper housing 102. This arrangement results in the bore 110 of the upper housing 102 having a portion 130 with an essentially smooth cylindrical inner surface that extends from the lower ends 126 of the raised ribs 124 to the bottom opening 114 in the bottom end of the upper housing 102. A plurality of slots 132 are formed in the tubular wall of the upper housing 102 proximate the bottom opening 114 in the bottom end of the upper housing 102. The slots 132 allow for the attachment of the lower housing 106 to the upper housing 102. In the illustrated example, there are four slots 132 that allow the lower housing 106 to be attached to the upper housing 102 in any one of four different angular orientations without any alteration of either the lower housing 106 or the upper housing 102.

The upper housing 102 has a central longitudinal axis l. The radial distance $d_1$ measured from the bottom 134 of each groove 128 to the central longitudinal axis l is greater than the radial distance $d_2$ measured from the top surface 136 of each raised rib 124 to the central longitudinal axis l. The radial distance $d_1$ measured from the bottom 134 of each groove 128 to the central longitudinal axis l is the same as the radial distance $d_3$ measured from the smooth cylindrical inner surface of the lower portion 130 of the bore 110 of the upper housing 102 to the central longitudinal axis l.

The lower housing 106 has a top opening 138 that registers with the bottom opening 114 of the upper housing 102 when the lower housing 106 and the upper housing 102 are assembled together. The lower housing 106 has a plurality of posts 140 that are equal in number to the slots 132. In the illustrated example, there are four posts 140. Each post 140 is resilient and has a tip portion 142 that has a cross section having a shape resembling a saw tooth. The saw tooth cross sectional shape of the tip portion 142 forms a catch surface 144 that is approximately perpendicular to the stem of the post 140. The tip portion 142 of each post 140 snaps into a respective slot 132 such that the catch surface 144 of each post 140 engages the respective slot 132 in order to attach the lower housing 106 to the upper housing 102. By providing four posts 140 and four slots 132 the lower housing 106 can be attached to the upper housing 102 in any one of four different angular orientations corresponding to the four points of the compass, i.e. north, east, south, and west.

The lower housing 106 has an elongated cavity 146 that extends from an opening 148 in the side of the lower housing 106 to a closed end 150 in a direction transverse, i.e. approximately perpendicular, to the central longitudinal axis l of the upper housing 102. The cavity 146 communicates with the top opening 138 of the lower housing 106. The cavity 146 houses at least a portion of the pawl 108 and supports the pawl 108 both for pivotal motion and for rectilinear motion in a direction parallel to the longitudinal axis k of elongated cavity 146. Accordingly, the cavity 146 also supports the pawl 108 both for pivotal motion and for rectilinear motion in a direction approximately perpendicular to the central longitudinal axis l of the upper housing 102.

The pawl 108 is pivotally movable about an axis of rotation h between a first angular position and a second angular position, and the pawl 108 is also rectilinearly movable between an extended position and a retracted position. In the retracted position a greater portion of the pawl 108 is received in the cavity 146 as compared to the pawl 108 in the extended position. The latch 100 includes biasing means for biasing the pawl 108 toward the first angular position and also biasing means for biasing the pawl 108 toward the extended position. In the illustrated embodiment 100, the biasing means for biasing the pawl 108 toward the first angular position and the biasing means for biasing the pawl 108 toward the extended position are provided by the same structural elements. These structural elements are the compression spring 152 and the guide 154. The guide 154 is supported by the elongated cavity 146 for rectilinear motion in a direction approximately parallel to the longitudinal axis k of elongated cavity 146 and approximately perpendicular to the central longitudinal axis l of the upper housing 102. The spring 152 is positioned to extend between the closed end 150 of the elongated cavity 146 and the guide 154, and the spring 152 biases the guide 154 into contact with the pawl 108. The guide 154 is rectilinearly movable parallel to the longitudinal axis k of elongated cavity 146 between an extended position and a retracted position corresponding respectively to the extended and retracted positions of the pawl 108. The spring 152 pushes the guide 154 and in turn the pawl 108 toward the extended position. Thus the spring 152 biases both the guide 154 and the pawl 108 toward the extended position. It is contemplated by the inventors that as a variation of the illustrated embodiment, a separate spring could be provided for biasing the pawl toward the first angular position and another spring such as spring 152 could be provided for biasing the pawl and the guide rectilinearly toward the extended position.

The point of contact between the guide 154 and the pawl 108 is off set relative to the axis of rotation h of the pawl 108, at least when the pawl 108 is pivotally moved out of the first angular position, such that the force exerted by the spring 152 on the pawl 108 via the guide 154 imparts a torque to the pawl 108 that tends to restore the pawl 108 to the first angular position. Thus spring 152 in cooperation with the guide 154 biases the pawl 108 both rectilinearly toward the extended position and pivotally toward the first angular position. Accordingly, the spring 152 and the guide 154 provide both the biasing means for biasing the pawl 108 toward the first angular position and the biasing means for biasing the pawl 108 toward the extended position.

The pawl 108 is chisel-shaped in profile and has a cam surface 156 on one side and a catch surface 158 on the other side. The catch surface 158 faces toward the flange 116 and the cam surface 156 faces away from the flange 116. When the pawl 108 is in the first angular position, the catch surface 158 is approximately parallel to the longitudinal axis k of elongated cavity 146 and approximately perpendicular to the central longitudinal axis l of the upper housing 102. The cam surface 156 is at an acute angle relative to the catch surface 158, and the cam surface 156 and the catch surface 158 approach closest to one another near the tip 160 of the pawl 108. Furthermore, the cam surface 156 is at an angle relative to the longitudinal axis k of elongated cavity 146 when the pawl 108 is in the first angular position.

The pawl 108 has two cylindrical projections 162 and 164 that project from either side of the pawl 108 and are received in elongated grooves 166 and 168, respectively. The grooves 166 and 168 are provided on opposite sides of the cavity 146 and extend along at least a portion of the cavity 146 in a direction approximately parallel to the longitudinal axis k of elongated cavity 146. The grooves 166 and 168 support the projections 162 and 164 such that the pawl 108 can move pivotally about the axis of rotation h while simultaneously being capable of rectilinear translational movement along the length of the cavity 146. The projections 162 and 164 define the axis of rotation h of the pawl 108. As an alternative it is contemplated that the pawl could be pivotally attached to the guide 154 itself. In such an alternative embodiment a separate spring is preferably provided for pivotally biasing the pawl toward the first angular position. The statement that the pawl is pivotally movable relative to the housing, with respect to either the upper housing or the lower housing or both, is in tended to encompass but is not limited to both the case were the pawl is pivotally attached to the guide and the case were cylindrical projections 162 and 164 are supported for pivotal and rectilinear movement in the grooves 166 and 168.

The knob 104 is movable between a retracted position and an extended position. In the retracted position the knob 104 is received in the bore 110 of the upper housing 102 such that the top surface 170 of the knob 104 is approximately flush with the upper surface of the flange 116, i.e. the top surface 170 of the knob 104 is within a few millimeters of being perfectly flush with the upper surface of the flange 116. In the extended position a portion of the knob 104 projects out of the top opening 112 of the upper housing 102 such that the knob 104 can be grasped by a user and used as a handle to pull the door 122 open. The latch 100 further includes means for selectively retaining the knob 104 in the retracted position. Furthermore, the latch 100 includes means to block the rotational movement of the pawl 108 when the knob 104 is in the retracted position. When the knob 104 is flush with the bezel or flange 116, the latch 100 provides a low profile aesthetically pleasing look to cabinetry.

In operation the latch 100 is mounted to the door 122 by positioning the upper housing through a hole 172 in the door 122 such that the upper flange 116 abuts the exterior surface of the door 122. Then the mounting nut 120 is engaged to the screw threads 118 on the portion of the upper housing 102 that is projecting from the interior side of the door 122. The mounting nut 120 is then tightened up against the interior surface of the door 122 to secure the latch 100 to the door 122 by capturing a portion of the door 122, which surrounds the hole 172 in the door 122, between the flange 116 and the mounting nut 120. A keeper 174 is mounted to a second member such as the doorframe 176 shown in the drawings. The keeper 174 is of a type referred to as a right angle keeper. The keeper 174 is positioned such that it can be engaged by the pawl 108 when the door 122 is in the closed position in order to secure the door 122 in the closed position.

The operation of the latch 100 will be explained with the door 122 initially in the open position and the latch 100 mounted to the door. As the door 122 is moved to the closed position the cam surface 156 of the pawl 108 encounters the keeper 174 such that the keeper 174 impacts the cam surface 156 of the pawl 108. In the first angular position, the angle of the cam surface 156 relative to the longitudinal axis k of elongated cavity 146 is such that the impact of the keeper 174 on the cam surface 156 of the pawl 108 results in a force directed toward the cavity 146 and pushes the pawl 108 to the retracted position while the pawl 108 is maintained in the first angular position. The door 122 can then move to the fully closed position. This sequence will occur regardless of whether the knob 104 is in the extended or retracted position as will become apparent later. Once the door 122 is in the fully closed position, the pawl 108 clears the keeper 174 and is moved back to the extended position under the biasing force of the spring 152, with the pawl 108 remaining in the first angular position. When the knob 104 is in the retracted position the means to block the rotational movement of the pawl 108 prevents the rotational movement of the pawl 108 toward the second angular position. If an attempt is made to pull the door 122 open, the catch surface 158 will engage the keeper 174. The force resulting from the engagement of the keeper 174 with the catch surface 158 will result in a force on the pawl 108 that is directed perpendicularly to the longitudinal axis k of elongated cavity 146 when the pawl 108 is in the first angular position, and accordingly the component of the resulting force directed toward the cavity 146 and that would move the pawl 108 to the retracted position will be zero. Furthermore, because the rotation of the pawl 108 is blocked, the pawl 108 cannot move out of engagement with the keeper 174. Thus the latch 100 secures the door 122 in the closed position when the knob 104 is in the retracted position.

When the knob 104 is in the extended position the pawl 108 can rotate toward the second angular position. If an attempt is made to pull the door 122 open with the knob 104 in the extended position, the catch surface 158 will engage the keeper 174. The force resulting from the engagement of the keeper 174 with the catch surface 158 will result in a force on the pawl 108 that is directed perpendicularly to the longitudinal axis k of elongated cavity 146 because the pawl 108 is initially in the first angular position. Accordingly, the component of the resulting force directed toward the cavity 146 and that would move the pawl 108 to the retracted position will be zero. However, the resulting force produces a torque on the pawl 108 that tends to rotate the pawl 108 toward the second angular position. Furthermore, because the rotation of the pawl 108 is no longer blocked, the pawl 108 can rotate toward the second angular position as the door is pulled open with sufficient force to overcome the resistance to the rotation of the pawl 108 due to spring 152. As the pawl 108 rotates toward the second angular position, the changing angle of the catch surface 158 relative to the keeper 174 results in a force directed toward the cavity 146 and can push the pawl 108 toward the retracted position while the pawl 108 is moving toward the second angular position. Depending upon the specific geometry of the pawl 108 and the relative spacing between the latch 100 and the keeper 174, the pawl 108 will move out of engagement with the keeper 174 by pure rotation or by a combination of rotation and rectilinear motion toward the retracted position as the door 122 is pulled open. Thus the door 122 can be opened when the knob 104 is in the extended position.

The door 122 can then be closed with the knob 104 in either the extended position or the retracted position to repeat the cycle just described. If the door is closed with the knob 104 in the extended position, the knob 104 can be moved to the retracted position after the door is closed to positively secure the door in the closed position. The same positive securing of the door 122 in the closed position would result if the door were to be closed with the knob 104 in the retracted position.

The latch 100 further includes a shaft 178, a ratchet 180, and two more compression springs 182 and 184. The shaft 178 has an annular flange 186. The knob 104 is attached to one end of the shaft 178 such that the knob 104 and the shaft 178 move rectilinearly as a unit. The flange 186 is spaced apart from the knob 104. The longitudinal axis of the shaft 178 is coincident with the longitudinal axis l of the upper housing 102. The knob 104 has a plurality of projections 188 that are distributed about its outer circumference. Each of the projections 188 is received in a respective one of the grooves 128. Thus the knob 104 is limited to rectilinear translational motion along the bore 110 of the upper housing 102. The compression spring 182 extends between the flange 186 and the top opening 138 of the lower housing 106 and biases the shaft 178 outward from the lower housing 106 and the knob 104 toward the extended position. The opening 138 provides clearance for the passage of the shaft 178 through the opening 138 and into the lower housing 106. The ratchet 180 has a hole 190 through which the elongated portions of shaft 178 can pass but not the flange 186. The ratchet 180 is positioned such that the portion of the ratchet 180 that defines the hole 190 is confined between the flange 186 and the knob 104. The spring 184 is positioned between the flange 186 and the ratchet 180 and biases the ratchet 180 into contact with the knob 104. The ratchet 180 has a plurality of lugs 192 projecting out from the cylindrical outer surface 194 of the ratchet 180. The plurality of lugs 192 are distributed around the circumference of the cylindrical outer surface 194 of the ratchet 180. The knob 104 has a plurality of saw teeth 196 projecting from its bottom in a direction parallel to the longitudinal axis l of the upper housing 102 and toward the lower housing 106. The saw teeth 196 provide sloping guide surfaces 198 that meet at the points of the saw teeth 196. The saw teeth 196 fit between the cylindrical outer surface 194 of the ratchet 180 and the top surfaces 136 of the raised ribs 124. The lugs 192 extend from the cylindrical outer surface 194 of the ratchet 180 to a radial distance from the central longitudinal axis l that is greater than the radial distance $d_2$ measured from the top surface 136 of each raised rib 124 to the central longitudinal axis l. Therefore, the lugs 192 can extend in to the grooves 128. The top surfaces of the lugs 192 that face the knob 104 have two sloping cam surfaces 200 and 202 connected by a surface 204 extending between them such that the top surfaces of the lugs 192 have a zigzag shape. The surfaces 200 and 204 meet at a sharp edge 206 and the surfaces 204 and 202 meet to form a notch 208. The chisel-shaped ends 126 of the raised ribs 124 also have sloping guide surfaces 210.

Operation of the means for selectively retaining the knob 104 in the retracted position will be explained with the knob 104 in the extended position. With the knob in this position, the lugs 192 and the projections 188 are positioned in the grooves 128, the shaft 178 is up as far as possible into the bore 110 of the upper housing 102 relative to the bottom end of the upper housing, and the guide surfaces 198 are in contact with the cam surfaces 200. As the knob 104 is pushed into the bore 110 of the upper housing 102 beyond its retracted position, the sides 212 of the lugs 192 eventually clear the raised ribs 124. The action of the cam surfaces 200 against the guide surfaces 198 causes the ratchet 180 to rotate such that the cam surface 202 of the lugs 192 becomes positioned under the sloping surfaces 210 of a respective raised rib 124. When the knob 104 is released the interaction of the surfaces 202 and 210 causes the point of the chisel-shaped end of each rib 124 to be caught in the notch 208 of a respective lug 192. Thus, the shaft 178 and the ratchet 180 are captured and retained in their positions corresponding to the retracted position of the knob 104, and consequently the knob 104 itself is secured in the retracted position. To release the knob 104 from the retracted position the knob 104 is depressed further into the bore 110 for about 3 mm beyond the retracted position. At this time the edges 206 clear the point of the chisel-shaped end of each rib 124 and the interaction of the cam surfaces 200 and the guide surfaces 198 causes the ratchet 180 to rotate such that the cam surface 200 of the lugs 192 becomes positioned under the sloping surfaces 210 of the respective raised ribs 124. When the knob 104 is released the interaction of the surfaces 200 and 210 causes the ratchet 180 to rotate such that the lugs 192 will once again register with the grooves 128. Consequently the knob 104 becomes free to move rectilinearly to its extended position under the bias of the spring 182.

The guide 154 has a pair of resilient legs 214 each of which is attached at one end to the top surface of the guide 154. The resilient legs extend in parallel and the free end of each leg 214 is formed into a block 216. As the knob 104 is moved to the retracted position, the shaft 178 projects farther into the lower is housing 106. The shaft 178 engages the beveled surfaces 218 of the blocks 216 and spreads the blocks 216 and the legs 214 apart. When the knob 104 is in the retracted position, the shaft 178 causes the legs 214 to spread apart such that the legs 214 and/or blocks 216 are positioned over the extension arms 222 of the pawl 108. With the legs 214 in this position, because of interference with the arms 222, the legs 214 block the rotation of the pawl 108 from the first angular position to the second angular position when the knob 104 is in the retracted position. With the knob 104 in the extended position, the legs 214 return to their relaxed positions close together where they do not interfere with the arms 222, which allows the pawl 108 to rotate from the first angular position to the second angular position. With the knob 104 in either the extended or the retracted position, closing the door will cause the pawl 108 and guide 154 to rectilinearly translate back into the cavity 146 of the lower housing 106. Once the pawl 108 clears the keeper, the spring 152 returns both the pawl 108 and the guide 154 to their original position. The only difference is that with the knob in the extended position, the shaft 178 does not interfere with the guide legs 214 as the pawl returns to its extended position. The guide legs 214 are spread apart again when the knob 104 is pushed down to the retracted position. With the knob 104 retracted during closing, the spring force due to spring 152 on the guide 154 forces the legs 214 to spread apart as the beveled surfaces 220 of the blocks 216 encounter the shaft 178.

Due to the oval shape of the flange 116, the latch 100 was designed so that the lower housing 106 can be assembled to the upper housing 102 in at least two different positions. This allows a uniform look for all latches on the doors regardless of whether the keeper is on the top or side of the doorframe.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. A latch assembly for releasably securing a first member in a closed position relative to a second member, the second member having a keeper in a fixed positional relationship therewith, the latch assembly comprising:

an upper housing adapted for mounting to the first member;

a lower housing attached to said upper housing and having a cavity;

a pawl supported by said cavity, said pawl being capable of pivotal and rectilinear motion relative to said cavity, and said pawl being rectilinearly movable between extended and retracted positions;

a knob supported by said upper housing for rectilinear movement between retracted and extended positions, said pawl being rotationally movable between a first angular position and a second angular position when said knob in said extended position of said knob;

means for selectively retaining said knob in said retracted position of said knob; and means to block rotational movement of said pawl when said knob is in said retracted position of said knob, wherein said means to block rotational movement of said pawl blocks rotational movement of said pawl toward said second angular position such that said pawl cannot move out of engagement with the keeper when said knob is in said retracted position of said knob.

2. A latch assembly according to claim 1, wherein the first member can be moved to the closed position with said knob in said retracted position, and the first member can be moved to the closed position with said knob in said extended position, when the latch assembly is installed to the first member such that in either case said pawl moves to said extended position of said pawl behind the keeper with said pawl in said first angular position.

3. A latch assembly according to claim 2, wherein said upper housing has a bore and a plurality of raised ribs, each of said raised ribs having an end, and wherein said means for selectively retaining said knob in said retracted position of said knob comprises:

a shaft positioned at least in part within said bore of said upper housing, said knob being attached to said shaft;

a ratchet having a central opening and a plurality of lugs distributed about the periphery thereof, said shaft passing through said central opening of said ratchet; and a spring biasing said shaft and said knob toward said extended position of said knob, wherein each of said plurality of lugs of said ratchet engages said end of a respective one of said plurality of raised ribs to retain said knob in said retracted position of said knob.

4. A latch assembly according to claim 3, wherein the latch assembly further comprises a plurality of grooves formed in said bore, each of said plurality of grooves being positioned intermediate a pair of said plurality of raised ribs, wherein said ratchet rotates incrementally responsive at least in part to said knob being depressed further into said bore of said upper housing relative to said retracted position of said knob such that each of said plurality of lugs of said ratchet is placed into registry with a respective one of said plurality of grooves to thereby allow said knob to move from said retracted position of said knob to said extended position of said knob.

5. A latch assembly according to claim 4, wherein said plurality of lugs of said ratchet have upper cam surfaces and said knob has a plurality of sloping guide surfaces that engage said upper cam surfaces of said plurality of lugs to thereby impart rotational motion to said ratchet due to rectilinear movement of said knob.

6. A latch assembly according to claim 5, wherein the latch assembly further comprises:

a guide supported for rectilinear movement by said cavity of said lower housing, said guide being rectilinearly movable between extended and retracted positions corresponding to said extended and retracted positions of said pawl, respectively; and biasing means for urging said guide toward said extended position thereof.

7. A latch assembly according to claim 6, wherein said pawl has a pair of cylindrical projections that project from either side of said pawl, and said cavity of said lower housing is provided with a pair of elongated grooves on opposite sides of said cavity of said lower housing, and each of said cylindrical projections is received in a respective one of said elongated grooves to thereby allow said pawl to move pivotally while simultaneously being capable of rectilinear movement relative to said cavity of said lower housing.

8. A latch assembly according to claim 7, wherein said means to block the rotational movement of said pawl when said knob is in said retracted position of said knob comprises:

a pair of resilient legs each of which is attached at one end to said guide, each of said pair of resilient legs having a free end;

a pair of blocks having beveled surfaces, each of said pair of blocks being provided at said free end of a respective one of said pair of resilient legs; and a pair of extension arms attached to said pawl and extending on either side of said guide, wherein when said knob is moved to said retracted position thereof, said shaft engages said beveled surfaces and moves said blocks apart to thereby position said blocks over said extension arms and thus block rotation of said pawl from said first angular position to said second angular position when said pawl is in said extended position thereof.

9. A latch assembly according to claim 1, wherein the latch assembly further comprises:

a guide supported for rectilinear movement by said cavity of said lower housing, said guide being rectilinearly movable between extended and retracted positions corresponding to said extended and retracted positions of said pawl, respectively; and biasing means for urging said guide toward said extended position thereof.

10. A latch assembly according to claim 9, wherein said pawl has a pair of cylindrical projections that project from either side of said pawl, and said cavity of said lower housing is provided with a pair of elongated grooves on opposite sides of said cavity of said lower housing, and each of said cylindrical projections is received in a respective one of said elongated grooves to thereby allow said pawl to move pivotally while simultaneously being capable of rectilinear movement relative to said cavity of said lower housing.

11. A latch assembly according to claim 10, wherein said upper housing has a bore and wherein said means to block the rotational movement of said pawl when said knob is in said retracted position of said knob comprises:

a shaft positioned at least in part within said bore of said upper housing, said knob being attached to said shaft;

a pair of resilient legs each of which is attached at one end to said guide, each of said pair of resilient legs having a free end;

a pair of blocks having beveled surfaces, each of said pair of blocks being provided at said free end of a respective one of said pair of resilient legs; and a pair of extension arms attached to said pawl and extending on either side of said guide, wherein when said knob is moved to said retracted position thereof, said shaft engages said beveled surfaces and moves said blocks apart to thereby position said blocks over said extension arms and thus block rotation of said pawl from said first angular position to said second angular position when said pawl is in said extended position thereof.

12. A method of operating a latch assembly, the method comprising the steps of:

providing a latch assembly comprising:

a housing; and a pawl supported for both pivotal movement relative to the housing and rectilinear movement relative to the housing;

mounting the latch assembly to a first member; and locking the latch assembly by a user selectively blocking pivotal movement of the pawl while allowing rectilinear movement of the pawl such that the first member can be moved to a closed position relative to a second member even when pivotal movement of the pawl is blocked, but the first member cannot be moved from the closed position relative to the second member to an open position relative to the second member when pivotal movement of the pawl is blocked.

13. A latch assembly for releasably securing a first member in a closed position relative to a second member, the second member having a keeper in a fixed positional relationship therewith, the latch assembly comprising:

a housing adapted for mounting to a closure member; and a pawl supported for both pivotal movement relative to said housing and rectilinear movement relative to said housing, wherein the latch assembly is operable between a locked configuration and an unlocked configuration and wherein said pawl is prevented from pivotal movement but is capable of rectilinear movement when the latch assembly is in said locked configuration, and said pawl is freed to move pivotally when said latch assembly is in said unlocked configuration such that said pawl can be moved out of engagement with the keeper.

14. A latch assembly according to claim 13, further comprising:

a knob supported by said housing for rectilinear movement between an extended position and a retracted position; and at least one blocking member movable in response to movement of said knob, wherein said blocking member essentially blocks pivotal movement of said pawl when said knob is in said retracted position.

15. A latch assembly according to claim 14, wherein said housing has a bore and wherein the latch assembly further comprises:

a shaft positioned at least in part within said bore of said housing, said knob being attached to said shaft, wherein said blocking member is one of a pair of blocking members and each one of said pair of blocking members comprises a resilient leg that is attached at one end to a block having beveled surfaces, wherein said pawl is provided with a pair of extension arms, and wherein when said knob is moved to said retracted position thereof, said shaft engages said beveled surface of said block of each of said pair of blocking members and moves said block of each of said pair of blocking members to a position over a respective one of said extension arms in order to block rotation of said pawl from said first angular position to said second angular position when said pawl is in said extended position thereof.

16. A latch assembly according to claim 15, wherein said bore has a plurality of raised ribs, each of said raised ribs having an end, and wherein the latch assembly further comprises:

a ratchet having a central opening and a plurality of lugs distributed about the periphery thereof, said shaft passing through said central opening of said ratchet; and a spring biasing said knob toward said extended position of said knob and said shaft toward a position corresponding to said extended position of said knob, wherein each of said plurality of lugs of said ratchet engages said end of a respective one of said plurality of raised ribs to retain said knob in said retracted position of said knob.

17. A latch assembly according to claim 16, wherein the latch assembly further comprises a plurality of grooves formed in said bore, each of said plurality of grooves being positioned intermediate a pair of said plurality of raised ribs, wherein said ratchet rotates incrementally responsive at least in part to said knob being depressed further into said bore of said housing relative to said retracted position of said knob such that each of said plurality of lugs of said ratchet is placed into registry with a respective one of said plurality of grooves to thereby allow said knob to move from said retracted position of said knob to said extended position of said knob.

18. A latch assembly according to claim 17, wherein said plurality of lugs of said ratchet have upper cam surfaces and said knob has a plurality of sloping guide surfaces that engage said upper cam surfaces of said plurality of lugs to thereby impart rotational motion to said ratchet due to rectilinear movement of said knob.

* * * * *